US011891200B1

(12) United States Patent
Zevely

(10) Patent No.: US 11,891,200 B1
(45) Date of Patent: Feb. 6, 2024

(54) CABLE TIE CARTRIDGE

(71) Applicant: ZEVFORCE, LLC, Vista, CA (US)

(72) Inventor: Ann Zevely, Vista, CA (US)

(73) Assignee: ZEVFORCE,LLC, Vista, CA (US)

( * ) Notice: Subject to any disclaimer, the term of this patent is extended or adjusted under 35 U.S.C. 154(b) by 0 days.

(21) Appl. No.: 17/894,806

(22) Filed: Aug. 24, 2022

(51) Int. Cl.
*B65B 13/02* (2006.01)

(52) U.S. Cl.
CPC ..... *B65B 13/027* (2013.01)

(58) Field of Classification Search
CPC ..... B65B 13/027
See application file for complete search history.

(56) References Cited

U.S. PATENT DOCUMENTS 5,417,252 A * 5/1995 Kurmis ..... B65B 13/027 140/93.2
5,417,253 A * 5/1995 Kurmis ..... B65B 13/027 140/93.2
5,845,681 A * 12/1998 Kurmis ..... B65B 13/027 100/30
2009/0078331 A1* 3/2009 DeMik ..... B65B 27/06 140/93.2

* cited by examiner

*Primary Examiner* — Matthew Katcoff
*Assistant Examiner* — Mohammed S. Alawadi
(74) *Attorney, Agent, or Firm* — Paul D. Chancellor; Ocean Law

(57) ABSTRACT

A cable tie cartridge with an internal curvilinear path, the cable tie cartridge for receiving, holding, and dispensing cable ties.

11 Claims, 7 Drawing Sheets

CABLE TIE CARTRIDGE

BACKGROUND OF THE INVENTION

Field of the Invention

This invention relates to the field of manufactured tools and manufactured tool accessories. More particularly, the present invention relates to holders and dispensers for cable ties.

Description of the Related Art

Cable ties are frequently held in the pockets of workmen as they are prone to spillage. Here and elsewhere, the pointed end of a cable tie can puncture a pocket or other similar holder while the cable tie head can snag on clothing or items found in the workplace.

Purpose made cable tie holders are known to suffer these and other similar problems. For example, known cable tie holders capture straight cable ties and thus must be long and/or suffer the puncture/snag problems mentioned above.

In particular, known cable tie holders generally do not incorporate a curvilinear cable tie path and a resilient flap inside a cable tie receiver. Rather, known examples simply encase straight cable ties, for example in foam rubber, without bending the cable ties along a curvilinear path and without passing the cable ties over a resilient flap.

SUMMARY OF THE INVENTION

A cable tie cartridge includes an internal curvilinear path, the cable tie cartridge for any of receiving, holding, and dispensing cable ties. The various embodiments described below may be taken alone or in any combination.

In an embodiment, a cable tie cartridge for holding and dispensing cable ties comprises a shell with a receiver and a receiver mouth having an external rim; the receiver mouth leading to a shell interior; the shell interior for receiving at least a portion of a cable tie via the receiver mouth; the cable tie cartridge for bending at least a portion of a tape section of the received cable tie along a curvilinear path; and, a flap having a resilient tongue for pressing at least a portion of the tape section of the received cable tie toward a cable tie cartridge wall.

In an embodiment, a cable tie cartridge wherein only a portion of the received cable tie is within the cable tie cartridge when the cable tie is fully inserted. In an embodiment, a cable tie cartridge wherein an exterior face of the cable tie cartridge has a substantially curvilinear boundary. In an embodiment, a cable tie cartridge wherein a shell interior provides the curvilinear path for receiving the cable tie. In an embodiment, a cable tie cartridge wherein the resilient tongue presses the cable tie tape section toward a shell outer wall.

In an embodiment, a cable tie cartridge with a flange having a hole therethrough; and, the hole used in linking the cable tie cartridge to a workman. In an embodiment, a cable tie cartridge wherein insertion of the cable tie into the cable tie cartridge is stopped by interference of a cable tie head with the receiver. In an embodiment, a cable tie cartridge wherein insertion of the cable tie into the cable tie cartridge is stopped by interference of a cable tie head with the receiver mouth rim.

In an embodiment, a cable tie cartridge wherein insertion of the cable tie into the cable tie cartridge is stopped by interference of a cable tie head with the flap. In an embodiment, a cable tie cartridge wherein insertion of the cable tie into the cable tie cartridge is stopped by interference of a cable tie pointed end with an obstruction within the cable tie cartridge. In an embodiment, a cable tie cartridge wherein the curvilinear path imparts a curvilinear shape to the received cable tie such that upon removal the cable tie retains a somewhat curvilinear shape.

In an embodiment, a method for storing and dispensing cable ties, the method comprising the steps of: providing a cable tie cartridge including a shell, a receiver, and a receiver mouth; inserting at least a portion of a cable tie into the cable tie cartridge such that the cable tie passes over a spring-like flap; the flap pushing an inserted portion of the cable tie toward an outer wall of the cable tie cartridge; a cable tie cartridge interior bending the cable tie along a curvilinear path; and, the receiver or a receiver appurtenance interfering with a cable tie head when the cable tie is fully inserted in the cable tie cartridge.

BRIEF DESCRIPTION OF THE DRAWINGS

The present invention is described with reference to the accompanying figures. These figures, incorporated herein and forming part of the specification, illustrate embodiments of the present invention and, together with the description provide examples enabling a person skilled in the relevant art to make and use the invention.

DESCRIPTION OF PREFERRED EMBODIMENTS

The disclosure provided in the following pages describes examples of some embodiments of the invention. The designs, figures, and description are non-limiting examples of embodiments they disclose. For example, other embodiments of the disclosed device and/or method may or may not include the features described herein. Moreover, disclosed advantages and benefits may apply to only certain embodiments of the invention and should not be used to limit the disclosed invention. Like drawing numbers indicate a similar, but not necessarily an identical structure.

To the extent parts and/or components of the described invention are connected, the associated interconnections and couplings may be direct or indirect unless explicitly described as being limited to one or the other. Notably, parts that are connected or coupled may be indirectly connected and may have interposed devices including devices known to persons of ordinary skill in the art.

In the present invention, various embodiments provide a cable tie cartridge for holding and/or dispensing cable ties.

Figure 1A:
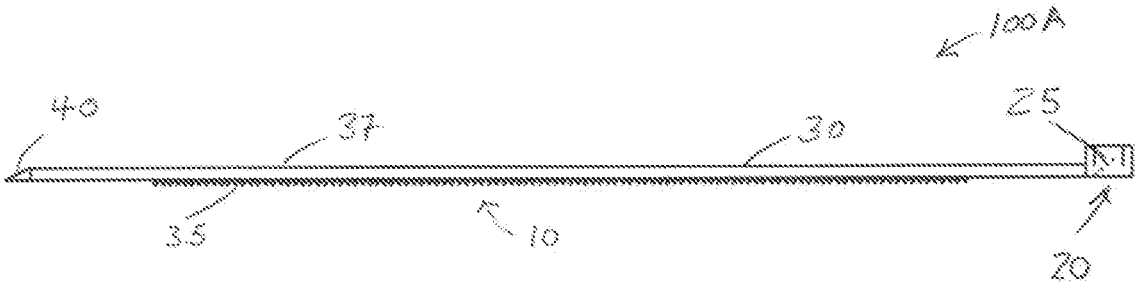
FIG. 1A shows a cable tie for use with the cable tie cartridge of the present invention.

FIG. 1A shows a drawing of a cable tie 100A. Typically constructed of a resilient material such as nylon or a suitable bendable plastic, the cable tie 10 includes a tape or tape section 30 between a head 20 and a tip or pointed end 40. The tape section bears teeth 35 for engaging a pawl 25 in the head when the tip is properly inserted in the head.

Figure 1B:
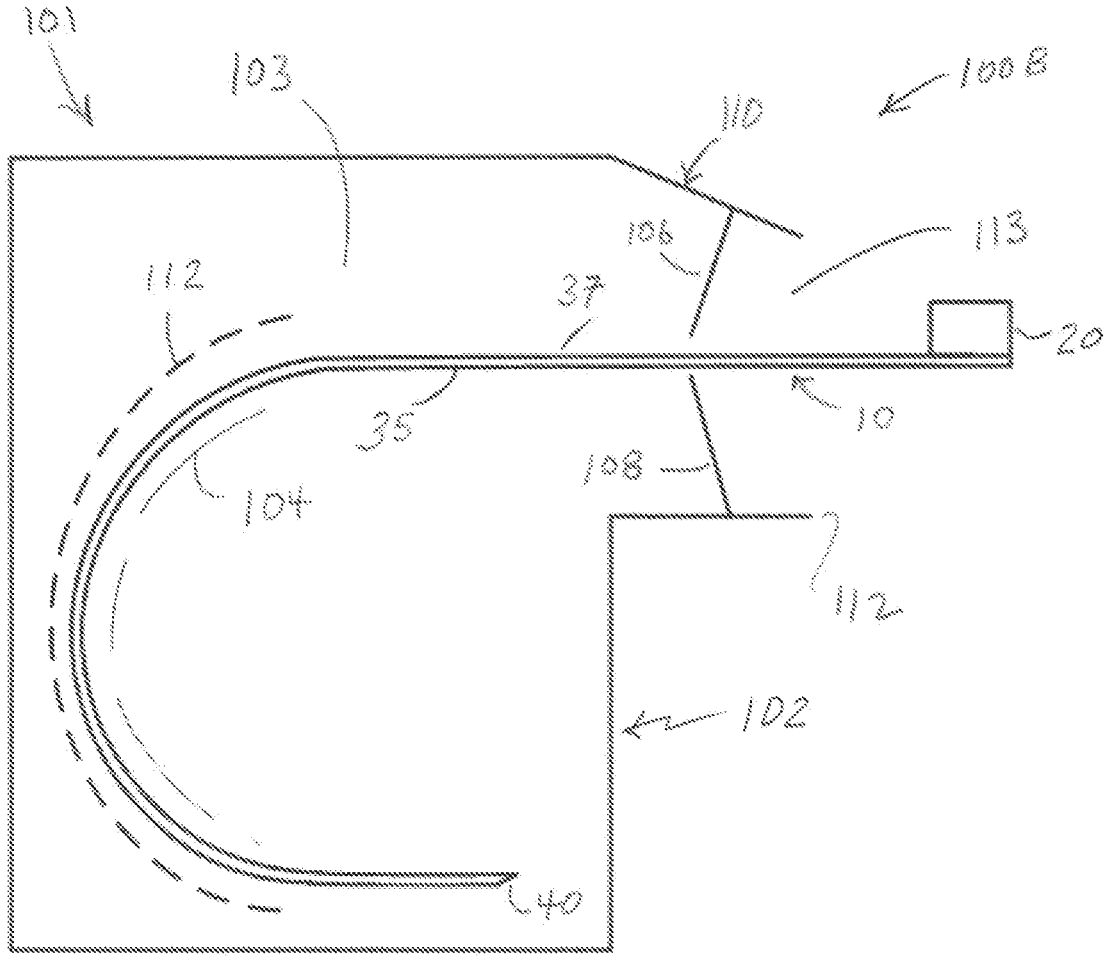
FIGS. 1B-C show schematic embodiments of cable tie cartridges.

FIG. 1B shows a schematic of a cable tie cartridge with a cable tie being inserted 100B. The cable tie cartridge 101 may have a rectangular or somewhat circular shape. The cable tie cartridge 101 includes a shell or outer shell 102 with an interior 103. The shell interior provides a deflector or path 112 for bending a cable tie 10 tape section 30 where the tip 40 of the cable tie is inserted first. For example, the cable tie is bent along a curvilinear path 104. A cable tie cartridge curvilinear path may impart a curvilinear shape to a received cable tie such that, upon removal from the cable tie cartridge, a curvilinear shape is at least somewhat retained by the cable tie.

A receiver 110 provides a passage into the shell 102 via a receiver mouth 113. A rim 112 of the mouth may provide a cable tie head 20 stop for limiting insertion of the cable tie into the shell.

In or near the receiver 110, the cartridge may include one or more flaps and the flaps may press against the cable tie 10 tape section 30. The flap or flaps may provide a stop for preventing a cable tie head 20 from passing over the flap or from entering the shell interior 103. For example a flap 108 may press against a toothless side of a tape section 37. For example a flap 106 may press against a side of a tape section with teeth 35. In some embodiments, a flap may be formed from a resilient or spring-like material such that it bends when a tape section passes over it. In some embodiments, the flap may extend from the receiver 110 or from the shell 102.

Figure 1C:
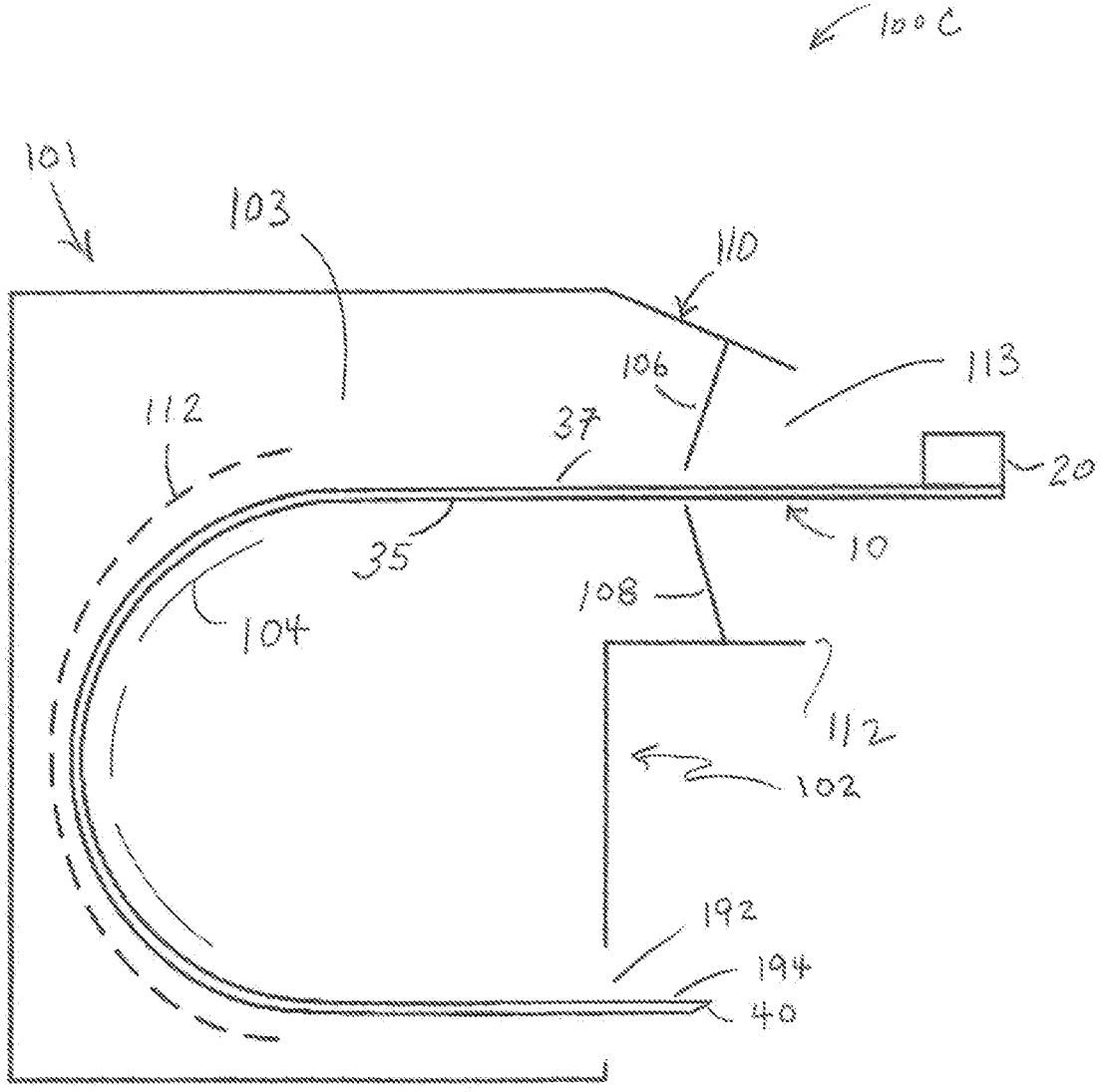

FIG. 1C shows another schematic of a cable tie cartridge with a cable tie being inserted 100C. FIG. 1C is similar to FIG. 1B. In FIG. 1C, the cable tie head 20 protrudes from the shell 102 at the receiver 110 and a section of the cable tie 194 including the cable tie pointed end 40 protrudes from the shell at a cable tie exit 192.

FIGS. 2-9 show embodiments of the cable tie cartridge that are similar to the cable tie cartridge of FIG. 1B-C.

Figure 2:
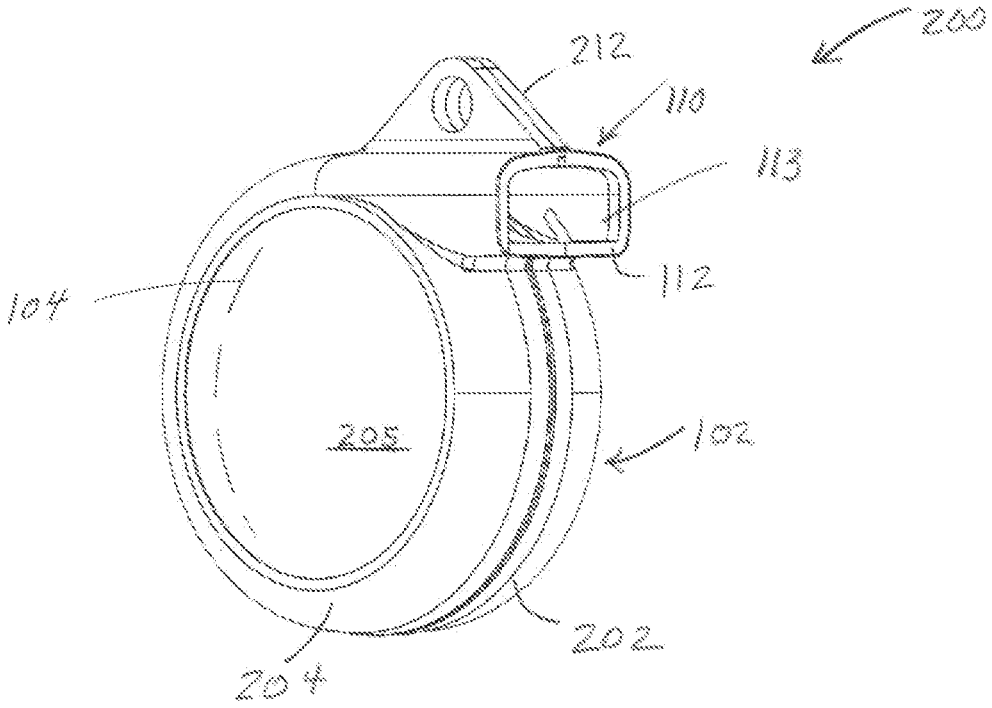
FIG. 2 shows a perspective view of an assembled cable tie cartridge similar to FIGS. 1B-C.

FIG. 2 shows a perspective view of an assembled cable tie cartridge 200. As seen, the cable tie cartridge 101 shell 102 may include a right shell portion 202 and a left shell portion 204 with the receiver 110 being formed at a location where the shell portions meet.

The receiver includes a receiver mouth 113 having a rim 112, the receiver mouth being the point of entry for inserting cable ties 10 into an interior 103 (see FIG. 3) of the shell 102. A face of the left shell portion 205 is exposed in this view. For securing the cable tie cartridge to a line or other tether (not shown), an attachment point such as a flange with a hole 212 may be provided. The attachment point or flange hole may be used for linking the cable tie cartridge to a workman.

Figure 3:
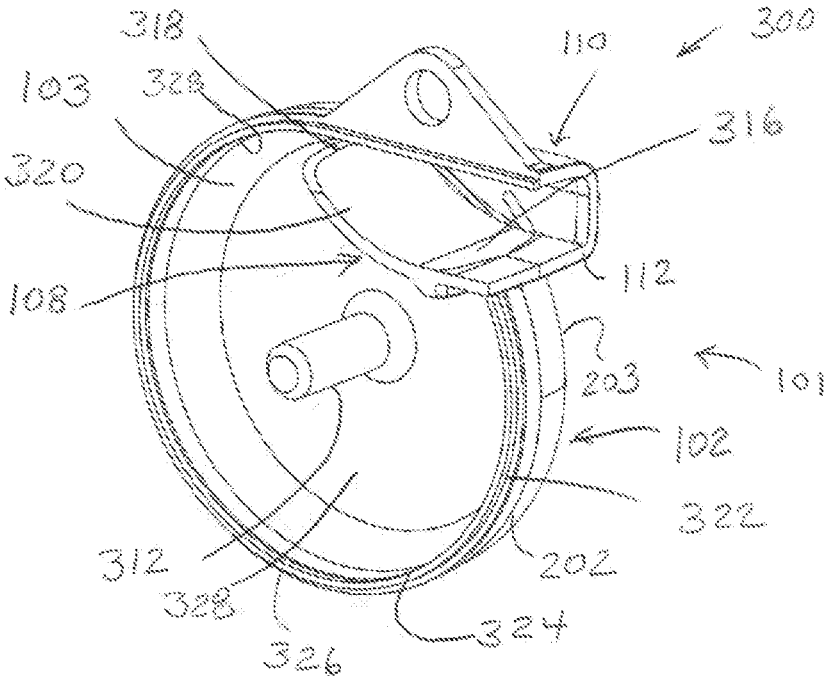
FIG. 3 shows an interior perspective view of the shell right side similar to FIGS. 1B-C.

FIG. 3 shows an interior perspective view of the shell right side 300. Here, a portion of the shell interior 103 is exposed in this view while a face of the right shell portion 202 is not exposed in this view. Also visible is a central post 312 extending from a back wall 328 of the right shell portion face. This post may be used to mate with the left shell portion 204.

In some embodiments, the shell portions 202, 204 are mated at a shell periphery 326. For example, this mating may occur at or near a medial plane 322, the mating provided by mechanical means such as one or more overlapping and/or underlapping shell portions 324 that fit or snap together, by adhesive adhesion, or by welding. Notably, cable tie cartridges mentioned herein may be made from plastic, metal, or another suitable material.

At, near, or within a receiver portion 110 is a flap for constraining a cable tie inserted in the cable tie cartridge 101. For example, a flap 108 may extend from or be a part of the receiver 110. For example, the flap may be joined with the receiver 316 and have a tongue 320 that reaches within the shell interior 103. A gap 318 may be formed between the tongue and the shell 102 before or after a cable tie tape section 30 (not shown) passes across the tongue. In various embodiments, the flap tongue is biased toward a shell periphery 328 such that the tape section 30 of an inserted cable tie 10 is captured between the tongue and the shell wherein the captured tape section may or may not touch the shell. Applicant notes that the flap mentioned here may, for example, be located in the left shell portion.

Figure 4:
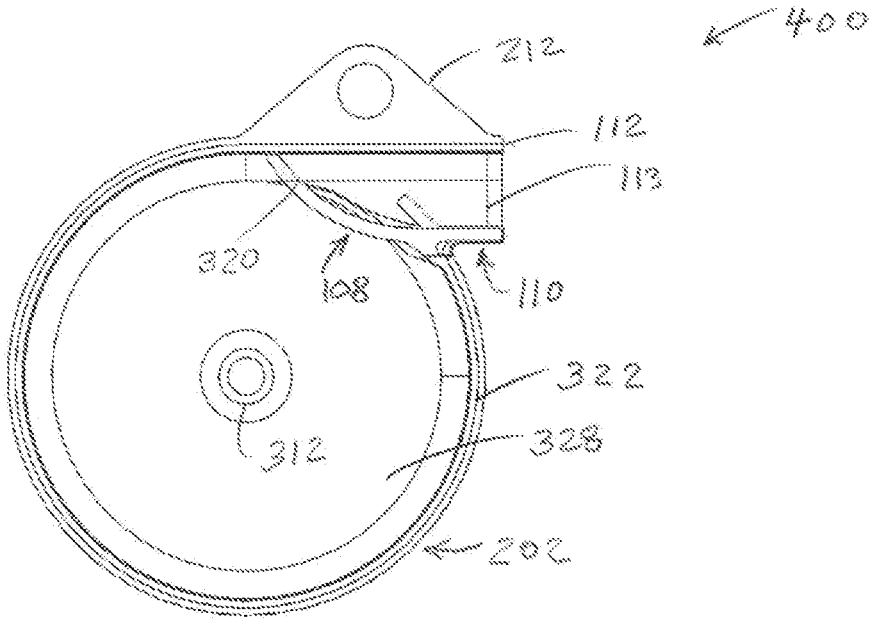
FIG. 4 shows an interior view of a cable tie cartridge right shell portion similar to FIGS. 1B-C.

FIG. 4 shows an interior view of a cable tie cartridge right shell portion 400. As shown, a medial plane 322 divides the cable tie cartridge shell 102 into right 202 and left 204 halves (use of the term half denotes one of two portions that need not be equal). Note that the cable tie cartridge right shell portion 202 is part of the cable tie cartridge shell 102 and may or may not be divisible or formed separately from the cable tie cartridge left shell portion 204.

As shown, the cable tie cartridge may include attachment point or flange 212 atop the receiver 110. The receiver mouth 113 is bounded by a mouth rim 112. Protruding from the receiver is a flap 108 with an extending tongue 320. Extending from the cartridge right shell is a post 312 which may be formed to fit a mating part of the cartridge left shell portion 204.

Figure 5:
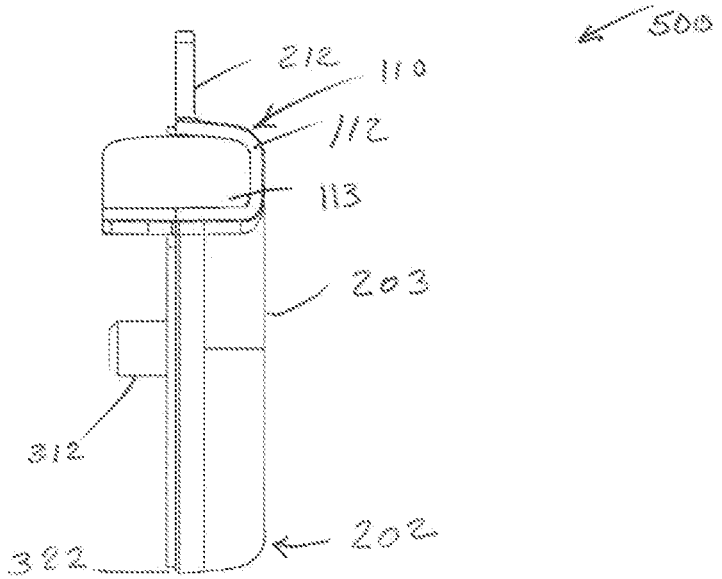
FIG. 5 shows a cable tie cartridge frontal view into a mouth portion of the cable tie cartridge right shell similar to FIGS. 1B-C.

FIG. 5 shows a cable tie cartridge frontal view into a mouth portion of the cable tie cartridge right shell 500. Cable tie cartridge right shell portion 202 includes a central post 312 extending from the back wall 328 of a right face 203. Looking at the receiver 110 and into the mouth interior 113 with rim 112, the optional attachment point 212 is seen in profile. Medial plane 322 divides shell left 202 and right 204 halves.

Figure 6:
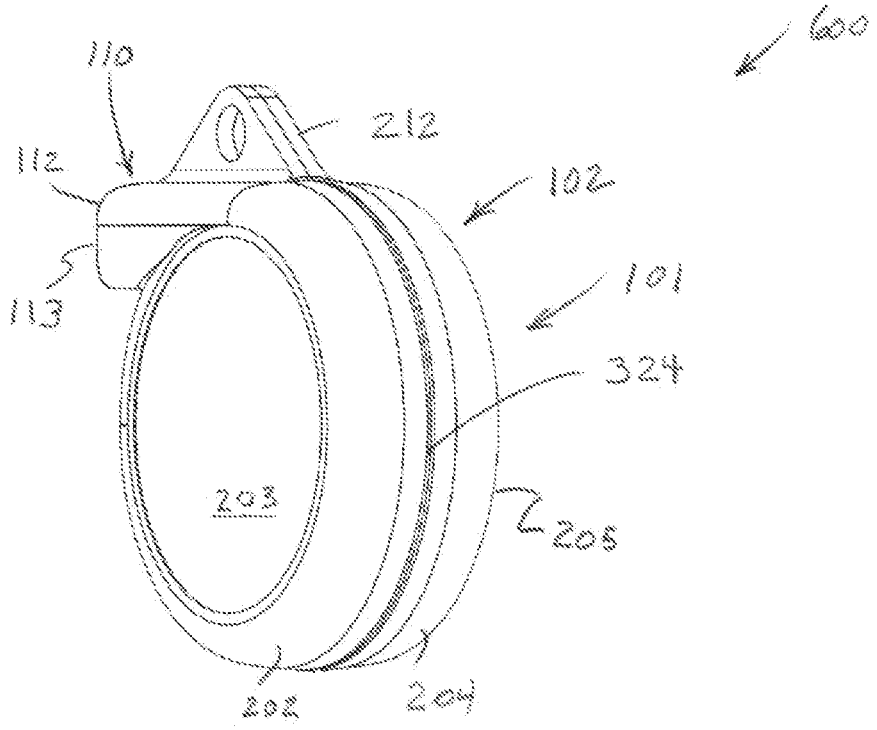
FIG. 6 shows a second perspective view of an assembled cable tie cartridge similar to FIGS. 1B-C.

FIG. 6 shows a second perspective view of an assembled cable tie cartridge 600. As seen, the cable tie cartridge 101 shell 102 may include a right shell portion 202 and a left shell 204 portion with the receiver 110 being formed at an edge of the shell portions.

The receiver includes a receiver 110 and a receiver mouth 113 having a rim 112. The receiver mouth is a point of entry for inserting cable ties 10 into the cable tie cartridge 101. A face 203 of the right shell portion 202 is exposed in this view while a face 205 of the left shell portion 204 is not exposed. A medial plane 324 may pass through an interface between the right and left cartridge shell portions 202, 204. For securing the cable tie cartridge to a line or other tether (not shown), an attachment point such as a flange with a hole 212 may be provided.

Figure 7:
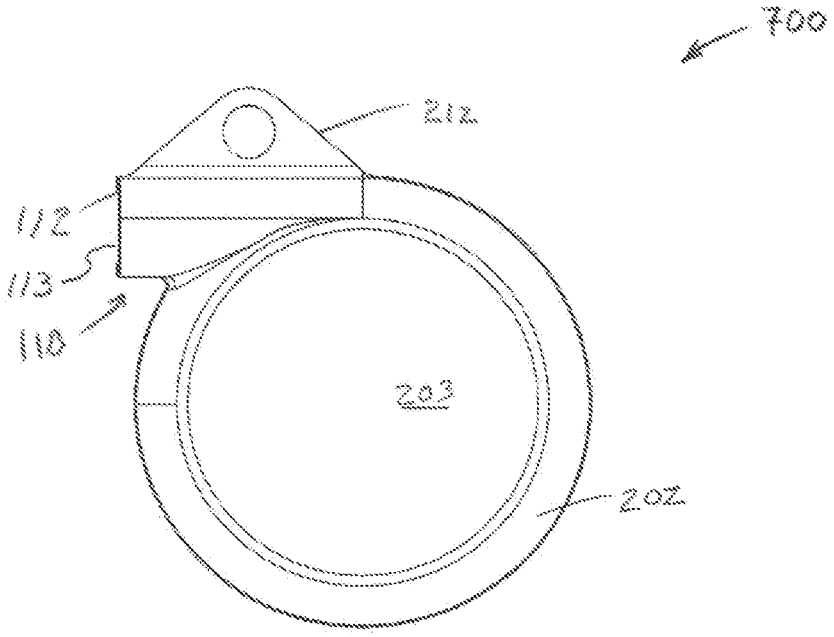
FIG. 7 shows an exterior view of a right cable tie cartridge shell portion similar to FIGS. 1B-C.

FIG. 7 shows an exterior view of a right cable tie cartridge shell portion 700. In this view, the exterior of right shell portion 202 is visible with a face 203. A cable tie receiver portion 110 interfaces with the right shell portion and provides an entryway for cable ties where the pointed end 40 of the cable tie may be inserted into the cable tie cartridge 101. The entryway is via a receiver mouth 113 having rim 112.

Figure 8:
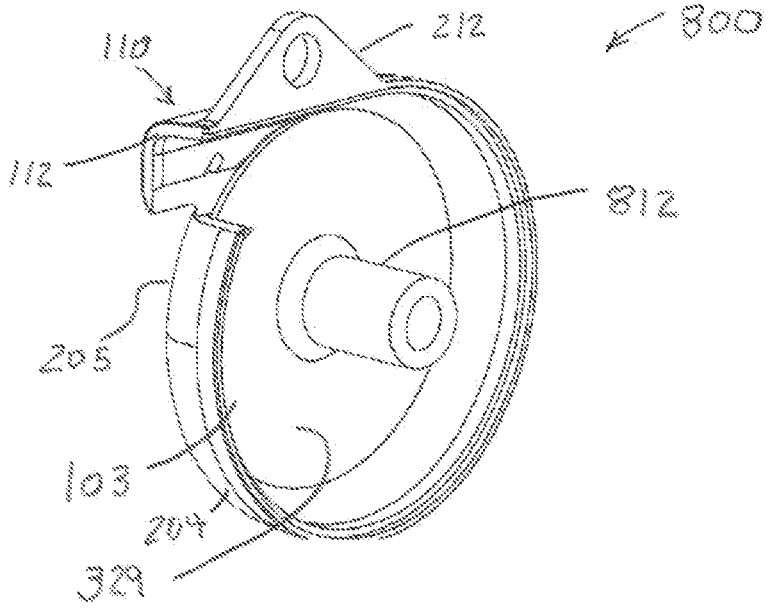
FIG. 8 shows an interior perspective view of a left cable tie cartridge shell portion similar to FIGS. 1B-C.

FIG. 8 shows an interior perspective view of a left cable tie cartridge shell portion 800. Here, a portion of the shell interior 103 is exposed in this view while a face of the left shell portion 205 is not exposed in this view. Also visible is a central post 812 extending from a back wall 329 of the left shell portion which along with post 312 may exist or not. In some embodiments, one or both posts may serve to fix the right and left shell portions 202, 204 together, for example by inserting one post into the other.

Figure 9:
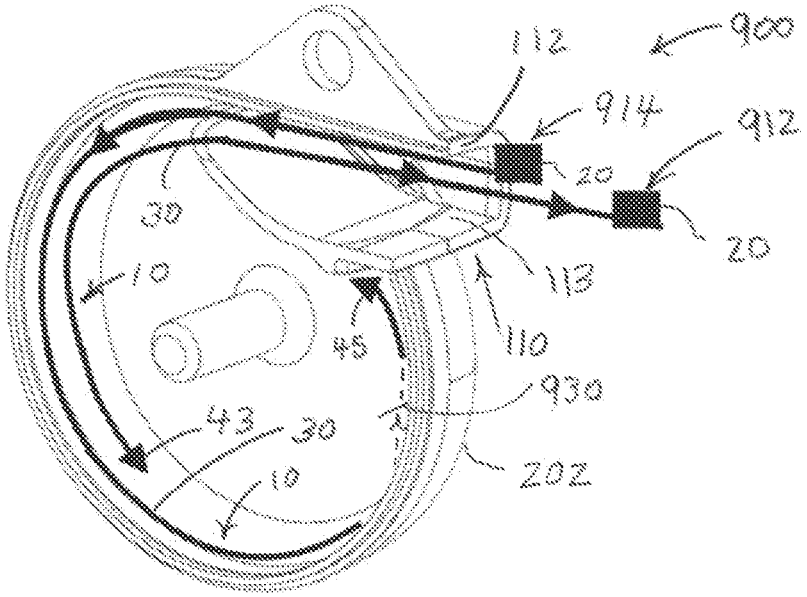
FIG. 9 shows a cable tie cartridge right shell interior with inserted cable ties similar to FIGS. 1B-C.

FIG. 9 shows a cable tie cartridge right shell interior with inserted cable ties 900. In an example, first cable tie 912 may be in the process of removal from the cable tie cartridge 101 as indicated by the arrows on the cable tie. In another example, the first cable tie 912 may be partially inserted in the shell such that the cable tie tip 40 and a portion of the tape section 30 is within the shell 202, the tape section following a circumferential path within the shell. The cable tie head 20 and an adjacent portion of the tape section is outside the shell and the receiver 110. The pointed end of the cable tie 43 may, as shown, be free to move further within the shell or it may be stopped in this position by a pointed end stop (not shown). In the alternative, the pointed end of the cable tie 43 may, when fully inserted, pass beneath the receiver 110. Notably, here and elsewhere multiple cable ties (2, 4 . . . or 100) may be inserted in the cable tie cartridge 101.

A second cable tie 914 may be inserted in the shell such that the cable tie head 20 is adjacent to or abuts the rim 112 of the receiver mouth 113. In some embodiments, the only portion of this cable tie 914 outside the confines of the cable tie cartridge 101 is the cable tie head. In this position, the cable tie pointed end 45 may be free or it may be stopped in this position by a pointed end stop such as end stop 930.

Notably, embodiments may provide various stops for a cable tie 10 or cable tie head 20. For example, the cable tie or cable tie head may be stopped by interference with: the rim 112 of the receiver mouth 113 or a rim within the receiver mouth; the flap 106, 108 (see also FIGS. 2, 3); a pointed end stop such as 930; or, a head stopping projection within the cable tie projection such as a receiver internal projection (not shown). Notably, embodiments may provide a cable tie pointed end 40 exit from the right and left shells 202, 204 or from either of the right or left shells (not shown).

Figure 10:
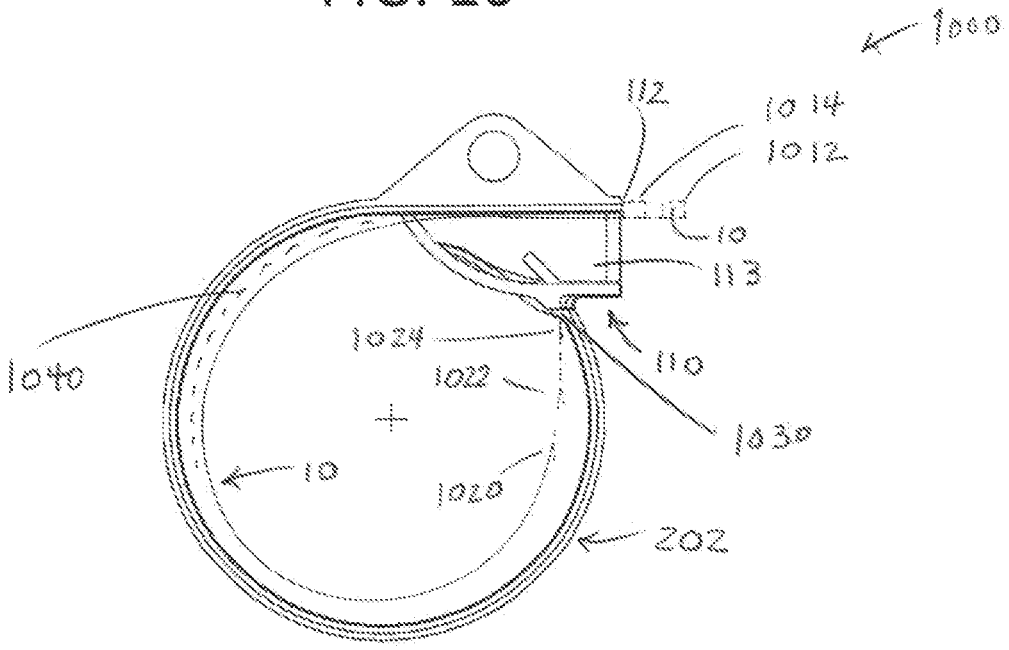
FIG. 10 shows a cable tie cartridge right shell interior with inserted cable ties similar to FIGS. 1B-C.

FIG. 10 shows a cable tie cartridge right shell interior with inserted cable ties 1000. In a first position 1012, a cable tie 10 may be partially inserted in the shell such that the cable tie does not enter or touch the receiver 110. Here, the cable tie pointed end may be in various positions within the cable tie cartridge such as abutted 1024 against a cable tie stop 1030 or not abutted against a cable tie stop 1022, 1020. In a second position 1014, a cable tie 10 may be inserted with its head adjacent to or abutting the receiver 110 or the receiver mouth or rim 113, 112. As before, the cable tie pointed end may be in various positions within the cable tie cartridge as mentioned above.

Within the cable tie cartridge, the cable tie follows a path that is not straight such as curved path 1040. Here, the cable tie pointed end may be in various positions within the cable tie cartridge such as abutted 1024 against a cable tie stop 1030 or not abutted against a cable tie stop 1022, 1020. Within the cable tie cartridge, the cable tie follows a path that is not straight such as curved path 1040.

While various embodiments of the present invention have been described above, it should be understood that they are presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A cable tie cartridge for holding and dispensing cable ties comprising:

a shell with a receiver and a receiver mouth having an external rim;

the receiver mouth leading to a shell interior;

the shell interior for receiving at least a portion of a cable tie via the receiver mouth;

the cable tie cartridge for bending at least a portion of a tape section of the received cable tie along a curvilinear path; and, a flap having a resilient tongue for pressing at least a portion of the tape section of the received cable tie toward a cable tie cartridge wall;

wherein only a portion of the received cable tie is within the cable tie cartridge when the cable tie is fully inserted.

2. The cable tie cartridge of claim 1 wherein an exterior face of the cable tie cartridge has a curvilinear boundary.

3. The cable tie cartridge of claim 2 wherein a shell interior provides the curvilinear path for receiving the cable tie.

4. The cable tie cartridge of claim 3 wherein the resilient tongue is for pressing at least a portion of the tape section of the received cable tie toward a cable tie cartridge wall.

5. The cable tie cartridge of claim 4 further comprising: a flange having a hole therethrough.

6. The cable tie cartridge of claim 1 wherein insertion of the cable tie into the cable tie cartridge is stopped by interference of a cable tie head with the receiver.

7. The cable tie cartridge of claim 1 wherein insertion of the cable tie into the cable tie cartridge is stopped by interference of a cable tie head with the receiver mouth rim.

8. The cable tie cartridge of claim 1 wherein insertion of the cable tie into the cable tie cartridge is stopped by interference of a cable tie head with the flap.

9. The cable tie cartridge of claim 1 wherein insertion of the cable tie into the cable tie cartridge is stopped by interference of a cable tie pointed end with an obstruction within the cable tie cartridge.

10. The cable tie cartridge of claim 1 wherein the curvilinear path imparts a curvilinear shape to the received cable tie such that upon removal the cable tie retains a somewhat curvilinear shape.

11. A method for holding and dispensing cable ties, the method comprising the steps of:

providing a cable tie cartridge including a shell, a receiver, and a receiver mouth;

inserting at least a portion of a cable tie into the cable tie cartridge such that the cable tie passes over a spring-like flap;

the flap pushing at least a portion of the cable tie inserted portion toward an outer wall of the cable tie cartridge;

bending the cable tie along a curvilinear path within the cable tie cartridge; and, the receiver or a receiver appurtenance for interfering with a cable tie head;

wherein only a portion of the received cable tie is within the cable tie cartridge when the cable tie is fully inserted.

* * * * *